US009550191B2

(12) United States Patent
De Lima et al.

(10) Patent No.: US 9,550,191 B2
(45) Date of Patent: Jan. 24, 2017

(54) FLOTATION OF SILICATES FROM ORES

(71) Applicant: Akzo Nobel Chemicals International B.V., Amersfoort (NL)

(72) Inventors: Odair Alves De Lima, São Paulo (BR); Kelly Ivone Pina Albino, São Paulo (BR)

(73) Assignee: AKZO NOBEL CHEMICALS INTERNATIONAL B.V., Arnhem (NL)

( * ) Notice: Subject to any disclaimer, the term of this patent is extended or adjusted under 35 U.S.C. 154(b) by 0 days.

(21) Appl. No.: 14/440,982

(22) PCT Filed: Dec. 2, 2013

(86) PCT No.: PCT/EP2013/075196
§ 371 (c)(1),
(2) Date: May 6, 2015

(87) PCT Pub. No.: WO2014/083197
PCT Pub. Date: Jun. 5, 2014

(65) Prior Publication Data

US 2015/0290659 A1 Oct. 15, 2015

Related U.S. Application Data

(60) Provisional application No. 61/731,622, filed on Nov. 30, 2012.

(51) Int. Cl.
*B03D 1/01* (2006.01)
*B03D 1/001* (2006.01)
*B03D 1/02* (2006.01)

(52) U.S. Cl.
CPC . *B03D 1/01* (2013.01); *B03D 1/02* (2013.01); *B03D 1/011* (2013.01); *B03D 2201/007* (2013.01); *B03D 2203/04* (2013.01)

(58) Field of Classification Search
None
See application file for complete search history.

(56) References Cited

U.S. PATENT DOCUMENTS

| | | | | |
|---|---|---|---|---|
| 2,327,408 | A * | 8/1943 | Ellis | B03D 1/002 209/166 |
| 2,857,331 | A | 10/1958 | Hollingsworth et al. | |
| 3,260,365 | A * | 7/1966 | Dickson | B03D 1/01 209/166 |
| 3,425,549 | A * | 2/1969 | Dickson | B03D 1/016 209/166 |
| 4,995,965 | A | 2/1991 | Mehaffey et al. | |
| 6,076,682 | A | 6/2000 | Gustafsson et al. | |
| 7,311,206 | B1 | 12/2007 | Svensson et al. | |
| 2010/0213105 | A1* | 8/2010 | De Oliveira Filho | B01F 3/0807 209/167 |

FOREIGN PATENT DOCUMENTS

| | | | |
|---|---|---|---|
| CA | 2585065 | A1 | 10/2008 |
| CN | 101337204 | A | 1/2009 |
| GB | 578694 | * | 7/1946 |
| GB | 578695 | * | 7/1946 |
| GB | 1355119 | A | 7/1971 |
| WO | 94/26419 | A1 | 11/1994 |
| WO | 2011/147855 | A2 | 12/2011 |
| WO | 2012/139986 | A2 | 10/2012 |

OTHER PUBLICATIONS

International Search Report and Written Opinion for PCT/EP2013/075196, date of mailing Mar. 3, 2014.

* cited by examiner

*Primary Examiner* — Thomas M Lithgow
(74) *Attorney, Agent, or Firm* — Matthew D. Kellam

(57) ABSTRACT

The present invention relates to a method for the flotation of silicates from ores in the presence of a collecting agent and an effective amount of a froth modifier/collecting booster comprising at least one of the compounds of general formula (I) or mixtures thereof: wherein X is C1-C3 alkyl; R' is straight or branched hydrocarbyl group containing 8 to 22 carbon atoms; n is integer from 2-4; m can vary from 0 to 2 and R' is X or —$(CH2)_n$-$N(X)_2$, with the proviso that when R' is —$(CH2)_n$-$N(X)_2$, then m is 1.

(I)

8 Claims, 3 Drawing Sheets

Figure 1 – Effect of the tertiary alkyldiamine (Duomeen TTM) on the flotation selectivity and recovery in a system with an amine condensate as collector.
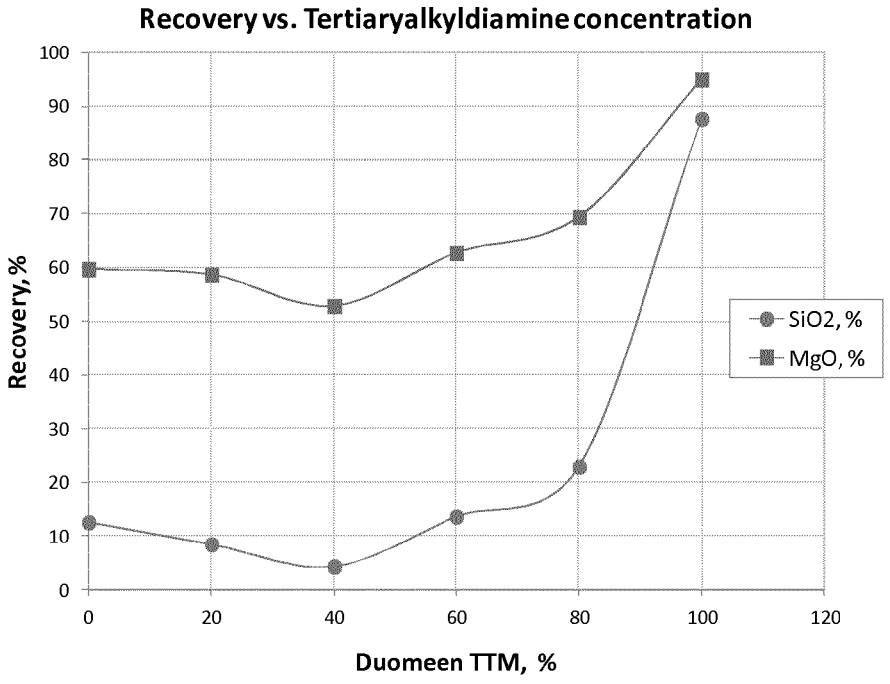
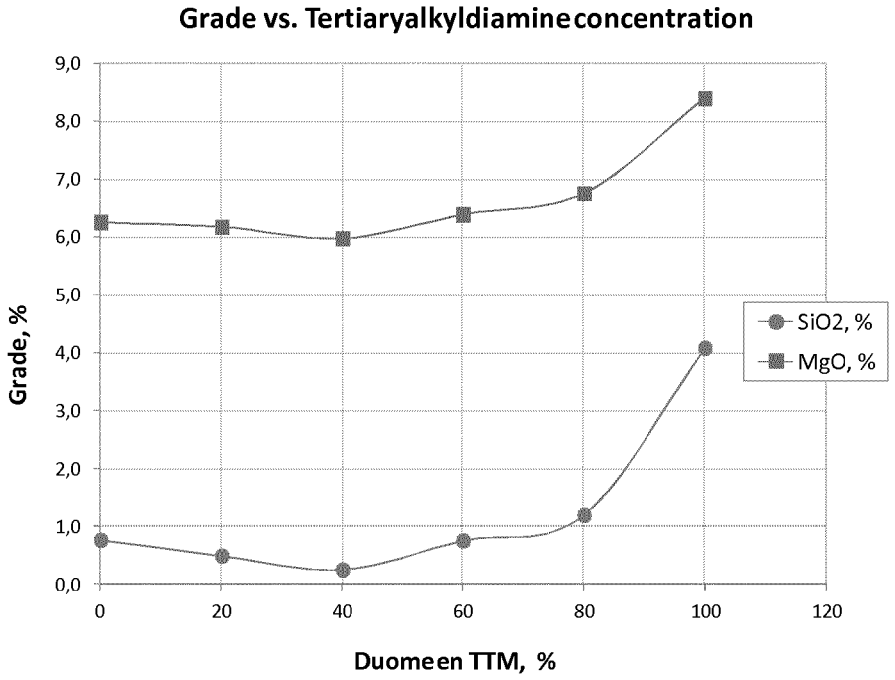

Figure 2 – Effect of tertiary alkyldiamine (Duomeen TTM) on the flotation performance in system with quaternary ammonium salt.
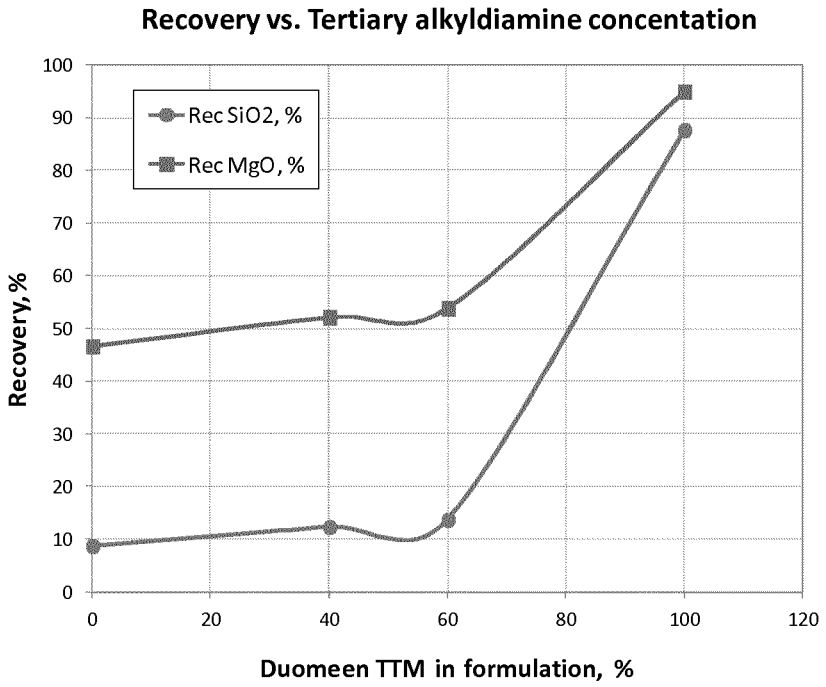
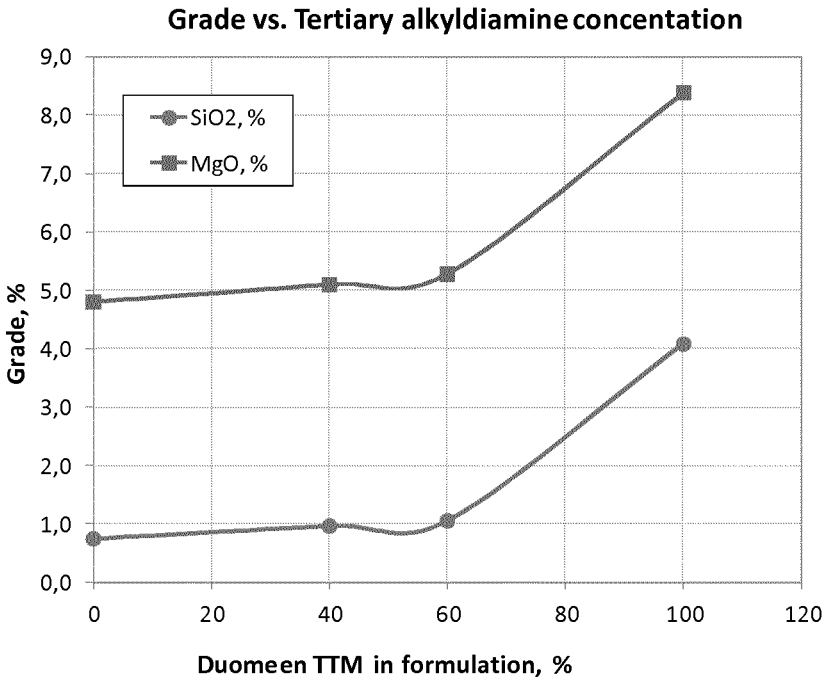

Figure 3 – Effect of tertiary alkyldiamines (Duomeen TTM) and tertiary alkylamines (Armeen DMTD) on the froth behavior in collector formulation containing amine condensate (Redicote C471): (a) 100% amine condensate as collector; (b) Amine condensate as collector together with 40% tertiary alkyldiamine; (c) 100% quaternary ammonium salt as collector and; (d) Quaternary ammonium salt as collector together with 40% tertiary alkyldiamine; (e) Amine condensate as collector together with 40% tertiary alkylamine.

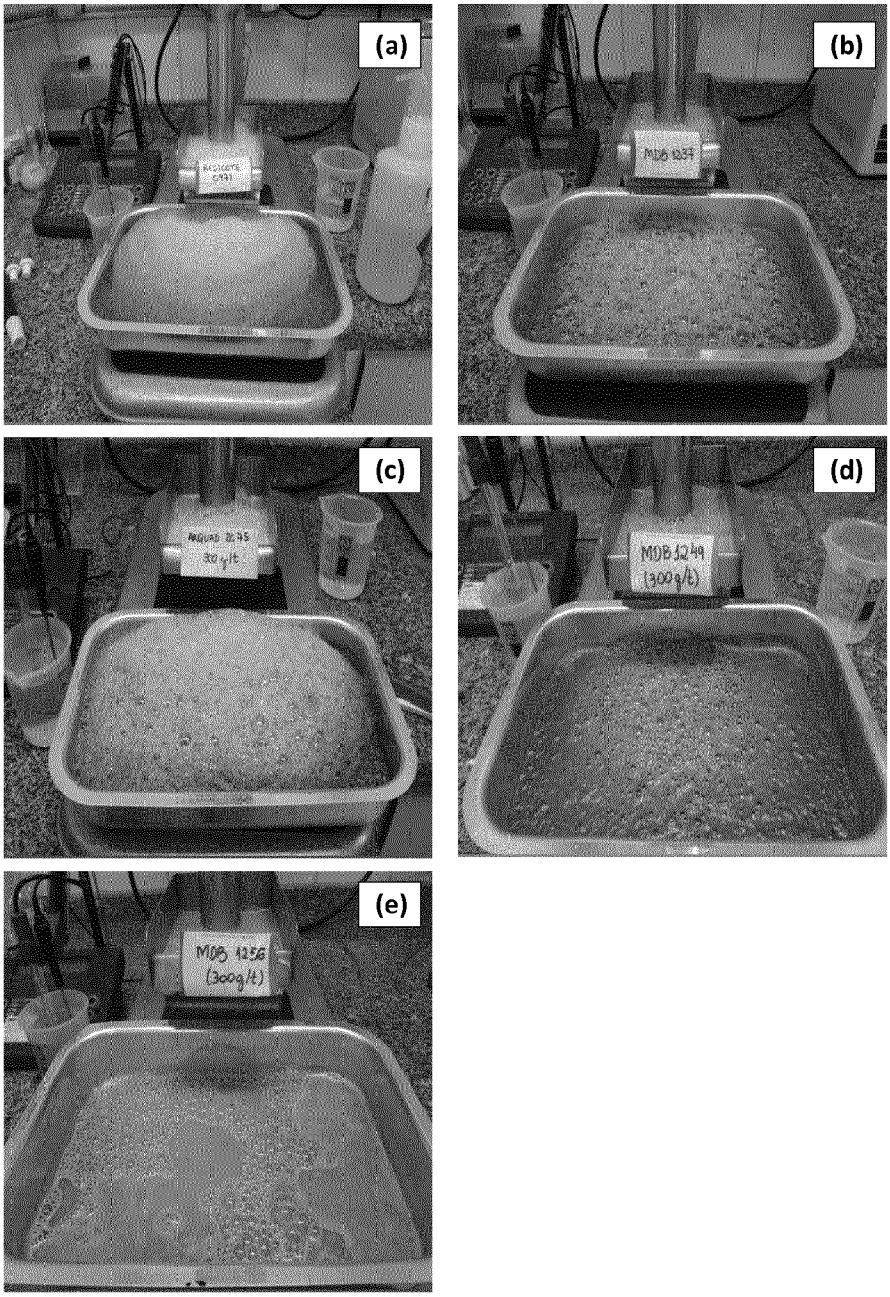

FLOTATION OF SILICATES FROM ORES

This application is a national stage filing under 35 U.S.C. §371 of PCT/EP2013/075196, filed Dec. 2, 2013, which claims priority to U.S. Provisional Patent Application No. 61/731,622 filed Nov. 30, 2012, the contents of which are each incorporated herein by reference in their entireties.

FIELD OF THE INVENTION

The present invention relates to the flotation of silicates from ores using tertiary alkylamines, tertiary alkyldiamines, alkyltriamines, and/or alkylamidoamines as froth modifiers and collector booster, particularly when coarse flotation feed is used. As the flotation feed gets coarser, within the limit of the maximum flotation size for each type of ore, the selectivity improvement becomes better, however, froth modification is observed at all particle size range.

BACKGROUND OF THE INVENTION

Calcium carbonate, iron ores and phosphate ores frequently contains a considerable amount of silicate. The presence of silicates is unacceptable in the beneficiation of these ores. It is therefore essential that the silicate content of the enriched mineral be reduced to a considerable extent, for instance, to a level below 1% by weight.

Silicate-containing minerals are generally removed from flotation systems by using reverse flotation technique whereby the silicates are floated in a pH range from natural pH to 10.5-11 and the beneficiated ore is concentrated in the bottom fraction. To accomplish this task, a cationic collecting agent is added to the mineral pulp in a conditioning tank so as to attach to the silicate bearing minerals surface thereby turning them hydrophobic. The silicates are then removed from the flotation cell through use of air bubbles injected into the mineral pulp.

Froth generation has become a key point in industrial flotation plants due to the many problems that an excess of froth can cause from difficulties to pump the material that contains the froth to environmental questions with governmental agencies. One common way to deal with excessive froth generation in full scale flotation plants is through the application of defoamers onto the froth. Defoamers are chemicals that are applied separately after flotation whenever froth volume or froth stability is an issue. Typically this is done as soon as it is collected in the flotation trough or as it travels to the concentration plant.

Various collecting agents are known in the art as silica collectors. For example, WO94/26419 discloses the use of quaternary ammonium compounds and an alkylene oxide adduct of an amine composition as silica flotation collector from calcium carbonate.

U.S. Pat. No. 4,995,965 discloses where silica is floated from calcium carbonate in the presence of collectors such as methyl bis(2hydroxypropyl) cocoalkyl ammonium methosulphate, dimethyl didecyl ammonium chloride, dimethyl di(2-ethylhexyl) ammonium chloride, dimethyl (2-ethylhexyl) cocoalkyl ammonium chloride, dicocoalkyl dimethyl ammonium chloride, and N-tallow alkyl 1,3-diamino propane diacetate.

U.S. Pat. No. 2,857,331 discloses beneficiation of, for example, calcite and phosphate by the use of a flotation reagent comprising a condensation reaction product of from 2.5 to 18 molecular equivalents of a commercially curde product selected from the group consisting of crude tall oil and tall oil pitch reacted with one molecular equivalent of a commercial polyalkylenepolyamine at atemperature of from about 300 to 4250° F.

WO2011147855A2 discloses the use of a polymeric quaternary ester product as a collector in a froth flotation process and to methods for the production of the polymeric quaternary ester.

U.S. Pat. No. 6,076,682 discloses the use of a combination of ether monoamine and ether polyamine as collector to remove silicate-containing minerals from iron ore by froth flotation in a pH range from 8 to 11 in the presence of a depressing agent for the iron mineral. The amine derivatives should present an aliphatic hydrocarbon group containing 6 to 22 carbon atoms wherein the ratio of ether monoamine and ether polyamine ranges from about 1:4-4:1.

U.S. Pat. No. 7,311,206 discloses the usage of collectors containing a quaternary ammonium compound to remove silicates from iron ore calling the attention to the high selectivity promoted by such chemicals in the removal of silicate-containing minerals by froth flotation in a pH range of 7-11.

WO 2012/139986A2 discloses the application of alkyl ether amine or alkyl ether diamines in the enrichment of iron ore by the removal of the silicate bearing minerals. The reverse flotation of iron ore is performed by using a collector or collector composition comprising at least one of the compounds: $ROXNH_2$, $ROXNH_3^+Y^-$, $ROXNHZNH_2$ and $ROXNHZNH_3^+Y^-$, where X is an aliphatic alkylene group containing 2 to 6 carbon atoms; Z is an aliphatic alkylene group containing 2 to 6 carbon atoms; Y is an anion; and R is an aliphatic group presenting a specific formula.

It is an objective of this invention to provide a new and improved method for the flotation of silicates from ores through use of a novel froth modifier and collector booster without compromising flotation performance.

SUMMARY OF THE INVENTION

The present invention relates to a method for the flotation of silicates from ores in the presence of a collecting agent and an effective amount of a froth modifier/collecting booster comprising at least one of the compounds of general formula I or mixtures thereof:

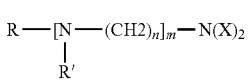

$$R-[N(R')-(CH2)_n]_m-N(X)_2 \quad (I)$$

wherein X is C1-C3 alkyl; R is straight or branched hydrocarbyl group containing 8 to 22 carbon atoms; n is integer from 2-4; m can vary from 0 to 2 and R' is X or —$(CH2)_n$-$N(X)_2$, with the proviso that when R' is —$(CH2)_n$-$N(X)_2$, then m is 1.

Tertiary alkyldiamines, when added to formulation for flotation collectors, enhance the froth quality by preventing excessive froth generation, reduce froth stability and improve flotation selectivity for the removal of silicates in flotation systems when coarse flotation feed is treated. Conversely, tertiary alkylamines when added to formulation for flotation collectors act as froth modifier only.

The invention also relates to a froth modifier/collection enhancer comprising at least one of the compounds of general formula I or mixtures thereof.

BRIEF DESCRIPTION OF THE DRAWINGS

FIG. 1 shows the effect of the tertiary alkyldiamine (Duomeen TTM) on the flotation selectivity and recovery in a system with an amine condensate as collector.

FIG. 2 shows the effect of tertiary alkyldiamine (Duomeen TTM) on the flotation performance in system with quaternary ammonium salt as collector.

FIG. 3 shows the effect of tertiary alkyldiamines (Duomeen TTM) and tertiary alkylamines (Armeen DMTD) on the froth behavior in collector formulation containing either amine condensate or quaternary ammonium salt.

DETAILED DESCRIPTION OF THE INVENTION

The present invention is related to an inverted froth flotation to remove silicate-containing minerals conducted at a pH of 7-11, preferably 9-11, in the presence of a collecting agent and a froth modifier of the invention.

In the flotation process according to the invention, the ore is ground, together with water, in a first step to the desired particle size. As a rule of thumb, the ore has a particle size below about 250 μm, however sometimes it may be even coarser as in the case presented in the examples of this invention. The ground ore is then suspended in water, and fine material is deslimed in conventional manner, for instance, by filtration, settling or centrifuging. Then from this ore, water slurry (pulp) is prepared. After conditioning of the ore, the collecting agent is generally added, if applicable partially neutralized, and the mixture is further conditioned for a period of time before the froth flotation is carried out. In addition to collector mentioned above other additives well known in flotation can be added. Examples of such additives are pH-adjusting agents, such as sodium carbonate and sodium hydroxide. Another example is depressants, such as hydrophilic polysaccharide, e.g. starch, such as maize starch activated by treatment with alkali. Other examples of hydrophilic polysaccharides are dextrin, quebracho and cellulose esters, such as carboxymethylcellulose and sulphomethylcellulose; cellulose ethers, such as methyl cellulose, hydroxyethylcellulose and ethyl hydroxyethylcellulose; hydrophilic gums, such as gum arabic, gum karaya, gum tragacanth and gum ghatti, alginates; and starch derivatives, such as carboxymethyl starch and phosphate starch. The depressing agent is normally added in an amount of about 10 to about 1000 g per tonne of ore. Other additives are polyelectrolytes such as polyphosphate and water glass which have a dispersant effect as well as a depressant effect. Other conventional additives are foaming agents, such as methylisobutylcarbinol, triethoxybutane and polypropylene oxide and its alkyl ethers. After completion of the flotation, a silicate-enriched is floated and a bottom fraction rich in valuable mineral and poor in silicate are withdrawn.

During the flotation process excessive froth can cause significant difficulties from an operational, environmental and cost standpoint. Use of the froth modifier of the present invention can significantly improve froth quality and boost performance of the flotation process.

The froth modifier of the present invention comprises at least one of the compounds of general formula I or mixtures thereof:

$$R-[N(R')-(CH2)_n]_m-N(X)_2 \quad (I)$$

wherein X is C1-C3 alkyl, in one embodiment C1-C2 alkyl; R is straight or branched hydrocarbyl group containing 8 to 22 carbon atoms, in one embodiment 12-22, in another embodiment 16-20, and in yet another embodiment 16-18; n is integer from 2-4; m can vary from 0 to 2 and R' is X or $-(CH2)_n-N(X)_2$, with the proviso that when R' is $-(CH2)_n-N(X)_2$, then m is 1.

The froth modifier of the present invention may be categorized as tertiary alkylamines, tertiary alkyldiamines, alkyltriamines, and/or alkylamidoamines Examples of compounds suitable for use as froth modifiers/collecting boosters include, but are not limited to, cocoalkyldimethylamine (available from Akzo Nobel Surface Chemistry LLC as Armeen DMCD); tallowalkyldimethylamine (available from Akzo Nobel Surface Chemistry LLC as Armeen DMTD); N,N,N-trimethyl-N'tallow-1,3-diaminopropane (available from Akzo Nobel Surface Chemistry LLC as Duomeen TTM); n,n,n'-trimethyl-n'-tallow alkyltrimethylenediamine; octadecyldimethylamine (available from Akzo Nobel Surface Chemistry LLC as Armeen DM18D); oleyl dimethylamine (available from Akzo Nobel Surface Chemistry LLC as Armeen DMOD); dodecyldimethylamine (available from Akzo Nobel Surface Chemistry LLC as Armeen DM12D); N,N-bis(3-dimethylaminopropyl) tallowamine (available from Akzo Nobel Surface Chemistry LLC as Triameen YTM); methylated tallowtriamine (available from Akzo Nobel Surface Chemistry LLC as Triameen TM); N-3-dimethylamino-tallowpropylamide (available from Akzo Nobel Surface Chemistry LLC as Armeen APA T); and N-3-dimethylamino-cocopropylamide (available from Akzo Nobel Surface Chemistry LLC as Armeen APA C1).

In one embodiment, the froth modifier is a tertiary alkyldiamine, e.g., tallow trimethylene diamine. In another embodiment, the froth modifier is a tertiary alkylamine, e.g., tallow alkyl dimethylamine, tertiary tallow alkyldiamine, coco alkyl dimethylamine, or mixtures thereof. In yet another embodiment, the froth modifier is an alkyltriamine, e.g., tallowalkyltriamine. In yet another embodiment, the froth modifier is an amidoamine, e.g., tallow or cocoalkylamidoamine.

The froth modifier can be added separately from the collecting agent, or together with the collecting agent as a single flotation agent. The total content of the two compounds varies over a wide range based on ore type, particle size and other process parameters but generally amounts to 50-1000 g/ton of ore to be floated. The collecting agent is generally a cationic product or a formulation of cationic and nonionic product. The cationic product can be one of many amine products. For example in some parts of industry a cationic product comprising a condensation reaction product of fatty acid and polyamine, hereafter referred to as amine condensate is used. In other parts of industry quaternary ammonium compounds are used by themselves or in combination with nonionics and/or amine condensates. Alkyletheramines are also used by industry as silica collectors.

The froth modifier may be added to the pulp in an amount of from about 5 to about 70% w/w based on the collecting agent. If an amine condensate is employed, the froth modifier may be added to the pulp in an amount of from about 5 to about 70% w/w based on the amount of amine condensate, in one embodiment, from about 5 to about 40% w/w, in another embodiment from about 10 to about 70% w/w, and in yet another embodiment from about 10 to about 40% w/w. If a quaternary ammonium compound is employed, the froth modifier may be added to the pulp in an amount of from about 5 to about 40% w/w based on the quaternary ammonium compound, in one embodiment, from about 5 to about 20% w/w. If an alkyletheramine compound is employed, the froth modifier may be added to the pulp in an amount of from about 5 to approximately 30% w/w based on the alkyletheramine compound, in one embodiment, from about 5 to about 20% w/w, in another embodiment from about 10 to about 20% w/w. When added to formulation for flotation collectors it enhances the froth quality by preventing excessive froth generation by reducing froth stability.

The froth modifier of the present invention reduces the amount of froth generated significantly improves froth quality by reducing froth stability. This enables the froth to be easily removed without the need of additional chemicals.

In addition to preventing excessive froth formation in the flotation process, for coarse flotation feed, the froth modifier according to the present invention (e.g., that of general formula I), when used with amine condensates, acts as a booster for the flotation, improves flotation selectivity for the removal of silicates in flotation systems. More particularly, when amine condensates are used as a flotation collector or as a component thereof, this typically leads to the generation of an excessive amount of froth. By adding the froth modifiers of the invention it was possible to improve either the froth quality or the flotation selectivity or both thereby providing a positive boosting effect on the flotation performance.

Due to this synergistic behavior between the froth modifier according to the present invention (e.g., that of general formula I) and conventional amine condensates such as condensates of fatty acids and polyamines used as co-collectors in silica flotation of coarse particles, the froth modifier according to the present invention act both as a froth modifier and a flotation selectivity booster in the removal of coarse silicates by flotation. Typical examples of fatty acids are caproic acid, caprylic acid, 2-ethyl hexanoic acid, capric acid, lauric acid, isotridecanoic acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and erucic acid and the technical mixtures thereof obtained, for example, in the pressure hydrolysis of natural fats and oils, in the reduction of aldehydes from Roelen's oxosynthesis or in the dimerization of unsaturated fatty acids. Technical fatty acids containing 12 to 18 carbon atoms, for example, coconut oil, palm oil, palm kernel oil or tallow fatty acids. Polyamines include polyamines, polyethylene polyamines and mixtures thereof. Polyamines include compounds containing three or more Nitrogen. FIG. 1 shows the influence of the amount of Duomeen TTM (tallowtrimethylenediamine) in a formulation with the amine condensate, (a condensate product of a polyamine and a fatty acid) on the flotation response of silicate removal from carbonates.

Conversely, if other conventional silica collectors are used as flotation collectors (or co-collectors), the addition of the froth modifiers of the invention do not have the same synergistic effect on selectivity, but it still significantly contributes to the effective control of the excessive froth formation by decreasing froth stability. Other conventional silica collectors include, but not limited to, chemistries such as dialkyl quaternary compounds, alkyletheramines and polymeric quaternary ester products. Dialkyl quaternary compounds can be represented as $R_1R_2R_3R_4N^+X^-$ where $R_1$ is a linear alkyl radical containing from 8 to 18 carbon atoms, $R_2$ is an alkyl radical containing from 8 to 18 carbon atoms or a benzyl radical, $R_3$ and $R_4$ may be the same or different and each represent an alkyl radical containing 1 to 2 carbon atoms, and X is a halide anion preferably a chloride ion. Alkyletheramines are either ethermonoamines or etherdiamines or mixtures thereof. The alkyl group presents an aliphatic hydrocarbon group straight or branched containing 6 to 22 carbon atoms. Examples of alkyletheramines include branched C13 etherdiamine, partially neutralized (available from Akzo Nobel Surface Chemistry LLC as Lilaflot D817M) and linear C12-C14 etherdiamine, partially neutralized (available from Akzo Nobel Surface Chemistry LLC as Lilaflot D826M). Polymeric quaternary ester products are products such as polymeric esterquats obtained by reacting alkanolamines with a mixture of monocarboxylic acids and dicarboxylic acids and quaternising the resulting esters or polyester quats produced by condensation of a fatty alcohol, optionally alkoxylated, a fatty acid alkanolamide, optionally alkoxylated or an alkoxylated secondary amine, a dicarboxylic acid and an alkanolamine where the condensation product has been quaternised by a suitable alkylating agent. In such systems, tertiary alkyldiamine concentrations higher than 20% w/w lead to negative impact on the flotation performance. FIG. 2 illustrates the behavior of using tertiary alkyldiamines in a formulation containing quaternary ammonium salt as collector.

Accordingly, the data shows that addition of the froth modifiers according to the present invention into a formulation of flotation collector has the effect of controlling the froth formation and its stability. For instance, if tertiary alkyldiamines are added to formulation containing amine condensates, its presence promotes both the improvement in the froth characteristics and the flotation response. In another instance, if tertiary alkylamines are added into collector formulation its presence promotes the improvement of the froth characteristics. Employing the technology of the present invention improves froth quality, generating less froth when compared to the surfactant (collector) alone (in the absence of the froth modifier of the invention). Froth quality also includes the froth stability which means that the addition of the froth modifier of the invention also contributes to the modulation of the froth breakage. For example, when tertiary alkyldiamines are added, flotation performance is also improved by increasing the selectivity to the removal of silicates from the ore-mineral (valuable mineral).

The invention will now be illustrated by the following non-limiting examples.

Example 1

A calcite ore was finely ground so that to present 58.73% passing through the aperture 210 μm (P85 equal to 420 μm). The flotation feed composition was approximately 4.5% Silica, 8.5% MgO and 43.41% CaO. This ore was put in a flotation cell and was conditioned at 30% solids load for 1 (one) minute at a pH range from 9-9.5. No depressing agent was added to the system. A condensate amine (available from Akzo Nobel Surface Chemistry LLC as Redicote C471) at a dosage of 300 g/t was used as collector and the material was floated at a pH range from 9-9.5 until the complete exhaustion of flotation. A single rougher flotation step was accomplished to remove the silicate-containing minerals. For comparison purposes, flotation tests were performed wherein a tertiary alkyldiamine and tertiary tallowalkylamine (available from Akzo Nobel Surface Chemistry LLC as Duomeen TTM and Armeen DMTD, respectively), were each added to the condensate amine in a proportion of 40% by weight. All the flotation procedures were maintained unchanged. The results obtained in those tests are depicted in Table 1.

TABLE 1

Effect of froth modifiers in the flotation response with condensate amine as primary collector.

| Collector | Concentrate | | | | | |
|---|---|---|---|---|---|---|
| | Grades, % | | | Metallurgical recoveries, % | | |
| | CaO | $SiO_2$ | MgO | CaO | $SiO_2$ | MgO |
| 100% Condensate amine | 47.4 | 0.76 | 6.25 | 88.46 | 12.56 | 59.59 |
| 60% amine condensate + 40% tertiary alkyldiamine | 48.0 | 0.25 | 5.97 | 81.92 | 4.29 | 52.75 |
| 60% amine condensate + 40% tertiary alkylamine | 47.7 | 0.98 | 6.26 | 88.89 | 16.83 | 61.30 |

The addition of the tertiary alkyldiamine led to an increment in the flotation selectivity by reducing the amount of silica in the concentrate. Both the recovery of $SiO_2$ and MgO were reduced in the flotation concentrate when the tertiary alkyldiamine was introduced into the collector's formulation. Together with this improvement in the selectivity, the froth quality (volume and stability) was tremendously affected as can be seen in Table 2 (and FIG. 3*a-b*), where it is also demonstrated the effect of tallowalkyltriamine as froth modifier in such system. The addition of the tertiary alkylamine at such concentration (40% w/w) presented similar flotation results obtained with the condensate amine itself. However, the froth was strongly positively affected. Actually, at such concentration level almost no froth was generated, as can be observed in Table 2 (and FIG. 3*a-e*), that also illustrates the effect on the froth of alkyltriamines in flotation system wherein condensate amines are used as collectors.

TABLE 2

Effect of froth modifiers on the froth properties (volume and stability). Froth heights, cm

| Time, min | 100% Condensate amine | 60% Condensate amine + 40% Tertiary alkyldiamine | 60% Condensate amine + 40% Tertiary Tallowalkylamine | 60% Condensate amine + 40% Alkyltriamine |
|---|---|---|---|---|
| 0 | 10.2 | 5.8 | 0.0 | 7.5 |
| 3 | 9.7 | 3.8 | 0.0 | 5.5 |
| 6 | 9.7 | 3.8 | 0.0 | 4.5 |
| 9 | 9.7 | 3.8 | 0.0 | 4.5 |
| 12 | 9.7 | 3.8 | 0.0 | 4.5 |
| 15 | 9.7 | 3.8 | 0.0 | 4.5 |

From Table 2 is possible to observe that not only was the froth volume reduced (lower initial height) but also the froth stability was affected in a positive way, that is, the froth was stable only enough to promote the separation via flotation bursting right after this step.

Example 2

A calcite ore was finely ground so that to present 58.73% passing through the aperture 210 μm (P85 equal to 420 μm). The flotation feed composition was approximately 4.5% Silica, 8.5% MgO and 43.41% CaO. This ore was put in a flotation cell and was conditioned at 30% solids load for 1 (one) minute at a pH range from 9-9.5. No depressing agent was added to the system. A quaternary ammonium salt (available from Akzo Nobel Surface Chemistry LLC as Arquad 2C 75, at a dosage of 300 g/t) was used as collector and the material was floated at a natural pH until the complete exhaustion of flotation. A single rougher flotation step was accomplished to remove the silicate-containing minerals. For comparison purposes, another flotation test was performed using as collector a formulation containing 60% of the same quaternary ammonium salt and 40% by weight of a tertiary alkyldiamine (available from Akzo Nobel Surface Chemistry LLC as Duomeen TTM) at the same dosage, 300 g/t. Those results were then compared to the one wherein 100% Duomeen TTM was used as collector, following identical modus operandi. Table 3 depicts the results obtained for flotation tests.

TABLE 3

Effect of froth modifiers in the flotation response with quaternary ammonium salt as primary collector.

| Collector | Concentrate | | | | | |
|---|---|---|---|---|---|---|
| | Grades, % | | | Metallurgical recoveries, % | | |
| | CaO | $SiO_2$ | MgO | CaO | $SiO_2$ | MgO |
| 100% quaternary ammonium salt | 49.9 | 4.80 | 0.74 | 88.78 | 46.53 | 8.66 |
| 60% quaternary ammonium salt + 40% tertiary alkyldiamine | 49.4 | 5.10 | 0.96 | 91.01 | 52.08 | 12.25 |
| 100% tertiary alkyldiamine (Duomeen TTM) | 43.8 | 8.39 | 4.08 | 97.83 | 94.95 | 87.62 |

It can be seen that when the tertiary alkyldiamine was added into the collector system, it did not lead to a better flotation response. However, it could truly improve the froth properties by reducing its amount, stability and volume as depicted in FIG. 3 (*c, d*) and quantified in Table 4. The tertiary alkyldiamine does not generate any froth when it is used as collector alone.

TABLE 4

Effect of froth modifiers on the froth properties when quaternary ammonium salt is used as primary collector. Froth heights, cm

| Time, min | 100% Quaternary ammonium salt | 60% Quaternary ammonium salt + 40% Tertiary alkyldiamine |
|---|---|---|
| 0 | 14.5 | 3.0 |
| 3 | 12.5 | 0.5 |
| 6 | 10.5 | 0.0 |
| 9 | 8.0 | 0.0 |
| 12 | 6.0 | 0.0 |
| 15 | 4.0 | 0.0 |

Tertiaryalkyl diamine, tertiary alkylamine and alkyltriamine alkyldiamine (available from Akzo Nobel Surface Chemistry LLC as Duomeen TTM, Armeen DM18D and Triameen YTM, respectively) were used to verify their effect as froth modifier with other type of quaternary ammonium salt (available from Akzo Nobel Surface Chemistry LLC as Arquad 2HT-50) and the results are showed in Table 5, wherein can be seen the effect on the froth volume and stability promoted by the froth modifiers of this invention.

TABLE 5

Effect of froth modifiers on the froth properties when quaternary ammonium salt (tallow) is used as primary collector. Froth heights, cm

| Time, min | 100% Quaternary ammonium salt | 60% Quaternary ammonium salt + 40% Tertiary alkyldiamine | 60% Quaternary ammonium salt + 40% Tertiary alkylamine | 60% Quaternary ammonium salt + 40% Alkyltriamine |
|---|---|---|---|---|
| 0 | 8.5 | 1.0 | 6.0 | 1.0 |
| 3 | 7.5 | 0.5 | 4.0 | 0.5 |
| 6 | 6.5 | 0.0 | 2.0 | 0.0 |
| 9 | 2.5 | 0.0 | 1.5 | 0.0 |
| 12 | 2.5 | 0.0 | 1.0 | 0.0 |
| 15 | 1.5 | 0.0 | 1.0 | 0.0 |

Example 3

A magnetite ore was finely ground to present P80 equal to 44 μm. The composition of the flotation feed was approximately 59.5% Fe and 9.3% SiO2. This ore was put in a flotation cell and was conditioned at 33% solids load for two minutes at a pH range from 9-9.5. No depressing agent was added to the system. An etheramine derivative chemical (available from Akzo Nobel Surface Chemistry as Lilaflot D826M, at a dosage of 200 g/t) was used as collector and the material was floated at a natural pH until the complete exhaustion of flotation. A single rougher flotation step was accomplished to remove the silicate-containing minerals. For comparison purposes, two other flotation tests were performed wherein 10% and 20% by weight of a tertiary alkylamine (available from Akzo Nobel Surface Chemistry as Armeen DM18D) were added in a composition with the etheramine derivative collector at a total dosage of 200 g/t. Except for the composition of the collector tested, all flotation procedures were performed identically. Table 6 depicts the results obtained in the flotation tests. The results summarized in Table 6 show that the addition of the tertiary alkylamine at a ratio of 10% (w/w) demonstrated the same performance presented by the classical etheramine derivative collector.

TABLE 6

Effect of froth modifiers in the flotation response with etheramine derivative as primary collector.

| | Concentrate (sunk product) | | Tailing (floated product) | | Metallurgical Recovery (concentrate) | | Mass Recovery |
|---|---|---|---|---|---|---|---|
| Collector | % Fe | % SiO2 | % Fe | % SiO2 | Rec Fe, % | Rec SiO2, % | (concentrate), % |
| 100% Etheramine derivative | 59.90 | 8.91 | 56.40 | 12.50 | 89.27 | 84.82 | 88.68 |
| 80% Etheramine derivative + 20% tertiary alkylamine | 60.00 | 9.07 | 54.90 | 13.60 | 92.82 | 88.75 | 92.20 |
| 90% Etheramine derivative + 10% tertiary alkylamine | 60.60 | 9.07 | 56.00 | 12.70 | 88.04 | 82.92 | 87.18 |

At 20% of tertiary alkylamine the results are slightly poorer regarding silica grade and Fe recovery in the concentrate product. However, in both situations the effect of adding this froth modifier on the froth properties was clearly visible, as can be observed in Table 7, which brings the dimensionless froth height (conducted by dividing the actual froth height h by the initial froth height, Ho) as a function of the time for the all the three tests described above.

TABLE 7

Effect of froth modifiers on the froth properties when etheramine derivative as primary collector. Nondimensional Froth heights, h/Ho

| Time, min | 100% Etheramine derivative (Ho = 7.0 cm) | 80% Etheramine derivative + 20% tertiary alkylamine (Ho = 6.5 cm) | 90% Etheramine derivative + 10% tertiary alkylamine (Ho = 8.0 cm) |
|---|---|---|---|
| 0 | 1.00 | 1.00 | 1.00 |
| 3 | 1.00 | 1.00 | 0.88 |
| 6 | 1.00 | 0.85 | 0.88 |
| 9 | 1.00 | 0.85 | 0.56 |
| 12 | 0.71 | 0.85 | 0.56 |
| 15 | 0.64 | 0.46 | 0.50 |

Example 4

A sedimentary phosphate ore was finely ground so that to present 90% passing through the aperture 210 μm (P90 equal to 210 μm). The composition of the flotation feed was approximately 26.8% P2O5, 42.2 CaO and 11.7% Silica. This ore was put in a flotation cell and was conditioned at 32% solids load for 1 (one) minute at a pH range from 7.5-8.5. After the rougher step, another flotation step (cleaner) was done with the floated material wherein more collector was added into the mineral pulp. No depressing agent was added to the system. A condensate amine (available from Akzo Nobel Surface Chemistry LLC as Redicote C450) was used as collector at a dosage of 500 g/t in the rougher step and 250 g/t at the cleaner step. The hydrophobic particles were then floated at natural pH until the complete exhaustion of flotation in each step. For comparison purposes, a test was conducted following exactly the same modus operandi of the test previously described, except for the fact that 15% by weight of tertiary alkylamine (available from Akzo Nobel Surface Chemistry LLC as Armeen DM18D), was added into the composition of the collector condensate amine. The result was then compared to the one wherein 100% condensate amine was used as collector. Table 8 depicts the results obtained for flotation tests where can be seen that the addition of the froth modifier (tertiary alkylamine) had little effect on the flotation response (grades and recoveries). Conversely, the froth behavior was affected by adding those chemicals, as can be seen in Table 9.

TABLE 8

Effect of froth modifiers in the flotation response when condensate amines are used as primary collector in phosphate flotation.

| | Concentrate | | Tailings | | Metallurgical Recovery (conc) | | Mass Recovery |
|---|---|---|---|---|---|---|---|
| Collector | % P2O5 | % SiO2 | % P2O5 | % SiO2 | P2O5, % | SiO2, % | (conc), % |
| 100% Condensate amine | 30.4 | 4.45 | 7.24 | 51.94 | 95.88 | 32.22 | 84.73 |
| 85% Condensate amine + 15% Tertiary alkylamine | 29.8 | 5.71 | 6.51 | 53.94 | 97.91 | 37.5 | 86.15 |

TABLE 9

Effect of froth modifiers on the froth properties when condensate amines are used as primary collector in phosphate flotation.

| Time, min | 100% Condensate amine (Ho = 14.5 cm) | 85% Condensate amine + 15% Tertiary alkylamine (Ho = 14.5 cm) |
|---|---|---|
| 0 | 1.00 | 1.00 |
| 3 | 0.45 | 0.03 |
| 6 | 0.38 | 0.00 |
| 9 | 0.38 | 0.00 |
| 12 | 0.31 | 0.00 |
| 15 | 0.31 | 0.00 |

We claim:

1. A process for enriching a mineral from a silicate-containing ore by carrying out a froth flotation in the presence of an amine condensate collecting or co-collecting agent and a froth modifier, wherein said froth modifier is selected from the group consisting of at least one of the compounds of general formula I or mixtures thereof:

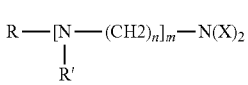

(I)

wherein X is C1-C3 alkyl; R is straight or branched hydrocarbyl group containing 8 to 22 carbon atoms; n is integer from 2-4; m can vary from 0 to 2 and R' is X or —$(CH2)_n$-$N(X)_2$, with the proviso that when R' is —$(CH2)_n$-$N(X)_2$, then m is 1; and wherein the froth modifier is added to the pulp in an amount of from about 5 to about 70% w/w based on the amount of amine condensate.

2. The process of claim 1 wherein X is an alkyl group containing from 1 to 2 carbon atoms.

3. The process of claim 1 wherein said froth modifier is n,n,n'-trimethyl-n'-tallow alkyltrimethylenediamine.

4. The process of claim 1 wherein said froth modifier is a tertiary alkylamine and is selected from the group consisting of tallow alkyl dimethylamine, coco alkyl dimethylamine, and mixtures thereof.

5. The process of claim 1 wherein said froth modifier is tallowalkyltriamine.

6. The process of claim 1 wherein the froth modifier is added to a pulp made from the ore in the form of an aqueous mixture.

7. A process for enriching a mineral from a silicate-containing ore by carrying out a froth flotation in the presence of a quaternary ammonium compound collecting or co-collecting agent and a froth modifier, wherein said froth modifier is selected from the group consisting of at least one of the compounds of general formula I or mixtures thereof:

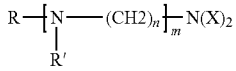

(I)

wherein X is C1-C3 alkyl; R is straight or branched hydrocarbyl group containing 8 to 22 carbon atoms; n is integer from 2-4; m can vary from 0 to 2 and R' is X or —$(CH2)_n$-$N(X)_2$, with the proviso that when R' is —$(CH2)_n$-$N(X)_2$, then m is 1; and wherein the froth modifier is added to the pulp in an amount of from about 5 to about 20% w/w based on the amount of quaternary ammonium compound.

8. A process for enriching a mineral from a silicate-containing ore by carrying out a froth flotation in the presence of an etheramine derivative compound collecting or co-collecting agent and a froth modifier, wherein said froth modifier is selected from the group consisting of at least one of the compounds of general formula I or mixtures thereof:

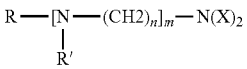

(I)

wherein X is C1-C3 alkyl; R is straight or branched hydrocarbyl group containing 8 to 22 carbon atoms; n is integer from 2-4; m can vary from 0 to 2 and R' is X or —$(CH2)_n$-$N(X)_2$, with the proviso that when R' is —$(CH2)_n$-$N(X)_2$, then m is 1; and wherein the froth modifier is added to the pulp in an amount of from about 5 to about 30% w/w based on the amount of etheramine derivative compound.

* * * * *